US008960090B2

(12) United States Patent
Yeomans

(10) Patent No.: US 8,960,090 B2
(45) Date of Patent: Feb. 24, 2015

(54) CRAFT TOOLS

(76) Inventor: John Frank Yeomans, Bleakedown (GB)

( * ) Notice: Subject to any disclaimer, the term of this patent is extended or adjusted under 35 U.S.C. 154(b) by 1536 days.

(21) Appl. No.: 12/459,742

(22) Filed: Jul. 7, 2009

(65) Prior Publication Data

US 2011/0146513 A1 Jun. 23, 2011
US 2014/0305324 A9 Oct. 16, 2014

(30) Foreign Application Priority Data

Jul. 4, 2008 (GB) ..... 0812238.4

(51) Int. Cl.

| | |
|---|---|
| ***B41K 1/56*** | (2006.01) |
| ***B26B 5/00*** | (2006.01) |
| ***B43K 29/20*** | (2006.01) |
| ***B43K 29/18*** | (2006.01) |
| ***B25F 1/02*** | (2006.01) |
| ***B41K 1/02*** | (2006.01) |

(52) U.S. Cl.

CPC ... *B26B 5/00* (2013.01); *B25F 1/02* (2013.01); *B41K 1/02* (2013.01); *B41K 1/56* (2013.01)
USPC ..... 101/405; 451/525; 30/340; 81/490; 7/158

(58) Field of Classification Search

CPC ..... B41K 1/003; B41K 1/56; B26B 5/00; B43K 29/20; B43K 29/18; B43K 29/06
USPC ..... 101/405, 406; 434/88; 451/523, 524, 451/525; 30/337, 339, 340, 341, 342; 81/438, 439, 489, 490; 7/167, 158, 160
See application file for complete search history.

(56) References Cited

U.S. PATENT DOCUMENTS

| | | | | |
|---|---|---|---|---|
| 1,250,328 | A * | 12/1917 | Langford | 81/436 |
| 3,280,662 | A * | 10/1966 | Frankenfield | 81/488 |
| 4,602,397 | A * | 7/1986 | Chao | 7/163 |
| 6,920,825 | B1 * | 7/2005 | Baxter | 101/327 |
| 7,024,772 | B1 | 4/2006 | Shaver et al. | |
| 7,055,249 | B1 | 6/2006 | Chao-Huan | |
| 7,818,843 | B2 * | 10/2010 | Kinskey et al. | 7/105 |
| 8,056,242 | B2 * | 11/2011 | Chen | 30/342 |
| 2005/0172496 | A1 | 8/2005 | Zeng | |

FOREIGN PATENT DOCUMENTS

| | | |
|---|---|---|
| GB | 2 197 821 A | 6/1988 |
| GB | 2197821 A | 10/1988 |

* cited by examiner

*Primary Examiner* — Leslie J Evanisko
(74) *Attorney, Agent, or Firm* — Kristofer E. Elbing

(57) ABSTRACT

This application relates to a baren 100 comprising a base 20 having a substantially flat surface 21 adapted for applying pressure to a work piece and a handle 10 removably connected to the base 20, wherein the handle 10 has an end that is adapted to receive a craft blade 60. the application also relates to a stamp 200 comprising a base 20' having a stamping surface 50 adapted for transferring a marking medium from the stamping surface 50 to a substrate and a handle 10' removably connected to the base 20', wherein the handle 10' has an end that is adapted to receive a craft blade 60.

17 Claims, 7 Drawing Sheets

PRIOR ART

CRAFT TOOLS

CROSS-REFERENCE TO RELATED APPLICATION

This application claims priority under 35 U.S.C. §119 to British Patent Application No. 0812238.4 filed on Jul. 4, 2008, which is herein incorporated by reference.

FIELD OF THE INVENTION

The present invention relates to craft tools, and particularly but not exclusively to a baren and a method of using a baren, and a stamp and a method of using a stamp.

BACKGROUND OF THE INVENTION

A baren is a tool that has traditionally been used in Japanese printmaking processes to apply pressure to paper over an ink block. In more modern times barens have also found use as an art and craft tool suitable for the hobbyist and for use in schools and colleges, for example, for block printing, scrapbooking, card crafting and other crafts requiring burnishing or even pressure distribution.

In one example application, a block or sheet of wood or linoleum is cut in a desired design, pattern etc and then ink, paint, dye or other marking medium is applied to the cut block/sheet. A piece of material (also referred to as a substrate) is placed on top of the inked block/sheet and pressure is applied to the material so that the marking medium is transferred to the material. The material might be, for example, paper, card, plastic, textile, wood, wallpaper, etc.

Generally, the baren provides a flat surface for providing substantially even pressure to a piece of work, for example for rubbing paper (or other material such as card of textile material) against an ink block. Barens can come in a variety of forms and a typical baren is illustrated in FIG. 1. U.S. Pat. No. 3,280,662 describes one such baren.

A stamp is a craft tool comprising a stamping medium such as rubber, lino or wood on which an image or pattern is formed (for example carved, moulded, or laser engraved) in relief. The stamp may be provided with a handle for ease of use. In use, a marking medium, such as ink, paint, dye or pigment is applied to the stamping medium. The coated stamp is then pressed onto a substrate to transfer the image to that substrate. A stamp may be supplied with the image preformed, or a user may create their own image, for example by carving.

SUMMARY OF THE INVENTION

According to a first aspect of the invention there is provided a baren comprising a base having a flat surface adapted for applying pressure to a work piece and a handle removably connected to the base, wherein the handle has an end that is adapted to receive a craft blade.

In this aspect a multifunctional apparatus is provided that can be used as both a baren and a craft knife. The apparatus is particularly useful because a baren and a craft knife are used in complementary processes in the art and craft of block printing: the knife is used to carve a block and then the baren is used to press material (typically paper) onto the block after inking the block.

The handle can serve both as a handle for a baren and as a handle for a craft knife thereby increasing convenience and more efficiently using storage space for the user and reducing cost for the manufacturer. In an embodiment of the invention the baren base is adapted to be connected to the handle of a previously sold craft knife so that a user (e.g. hobbyist or school/college) can extend the usability of existing craft knives by fitting a baren base to the craft handles. The base can be sold or otherwise supplied separately from the handle.

The baren may comprise a removable smoothing surface, such as a self-adhesive felt patch.

According to a second aspect of the invention there is provided a stamp comprising a base having a stamping surface adapted for transferring a marking medium from the stamping surface to a substrate, and a handle removably connected to the base, wherein the handle has an end that is adapted to receive a craft blade.

The stamping surface may comprise PVC or vinyl. The stamping surface may be arranged so that an image may be cut into the stamping surface by a user of the stamp using a craft knife. Alternatively, an image may be already provided on the stamping surface, for example by moulding, scoring or carving the stamping surface.

In a similar manner to the above baren, a multifunctional craft tool apparatus is provided that can be used as both a stamp and a craft knife. For example, a user may connect a craft blade to the handle to form a craft knife, which he might use to carve a design into the stamping surface of the base. The user might then transfer the handle to the base to form a stamp that can be inked to transfer the image to a surface.

The stamping surface may be removable from the base. That is, the stamping surface may be arranged so that it can be removed from the base without damaging the base. The stamping surface may further be arranged so that it can be reattached to the base. In such embodiments, a user can change images to be stamped without needing to purchase a new stamp each time by changing the stamping surface.

In some embodiments, a craft tool can be used as a baren as well as a stamp and a craft knife, allowing a user to choose between two different methods of creating an image using the same apparatus.

In a craft tool in accordance with either of the above embodiments, the base may comprise a cavity suitable for storing one or more craft tool tips, such as blades. By having a cavity in the base a convenient storage compartment is provided so that a variety of tips may be stored with the base when they are not in use. In this way the tips/blades are unlikely to lost or mislaid and are readily at hand. When any particular blade is not in use it can be placed in the cavity rather than on a work surface, in this way the user and other people are protected from the sharp edges of the blades and the blades are also protected against damage.

The craft tool may comprise a removable cap for covering the cavity in the base which may also be shaped to fit the palm of the hand. In this way the cap can have a dual purpose—containing the tips/blades within the base (that is, by forming a storage box) and providing a surface that allows pressure to be transmitted to the base by the user's palm.

In an embodiment of the invention the handle has a first end that has a screw thread for screwed connection to a corresponding thread on the base. The screwed connection of the handle with the base can be used to secure the cap over the cavity in the base.

The handle may be slotted for receiving a craft blade and the craft tool may further comprise a ferrule, that is, a band or cap adapted for threaded connection with the first end of the handle for securing a craft blade in/to the handle. The threaded connection of the handle may be adapted to receive both the ferrule and the handle so that the same thread can be used either for connecting the handle to the base or for securing a knife to the handle using the ferrule.

According to a third aspect of the invention there is provided a base for a craft tool comprising means for connection to a craft tool handle, wherein the base comprises a cavity for storing one or more craft tool tips. The craft tool handle comprises an end that is adapted to receive a craft tool tip.

The craft tool tips may comprise blades and/or burnishers, for example.

The means for connection may comprise a screw thread adapted to engage with a complementary screw thread on the handle.

The base may be suitable for use in either the first or second aspects of the invention.

According to a fourth aspect of the invention there is provided a method for using a craft tool, for example the baren of the first aspect of the invention, comprising at least one of: unscrewing a handle from the craft tool's base and connecting a craft tool tip to the handle; and removing a craft tool tip from the handle, storing the craft tool tip in the base and connecting the handle to the base.

The invention will now be described, by way of example only, with reference to the following drawings:

DETAILED DESCRIPTION OF AN ILLUSTRATIVE EMBODIMENT

Figure 2:
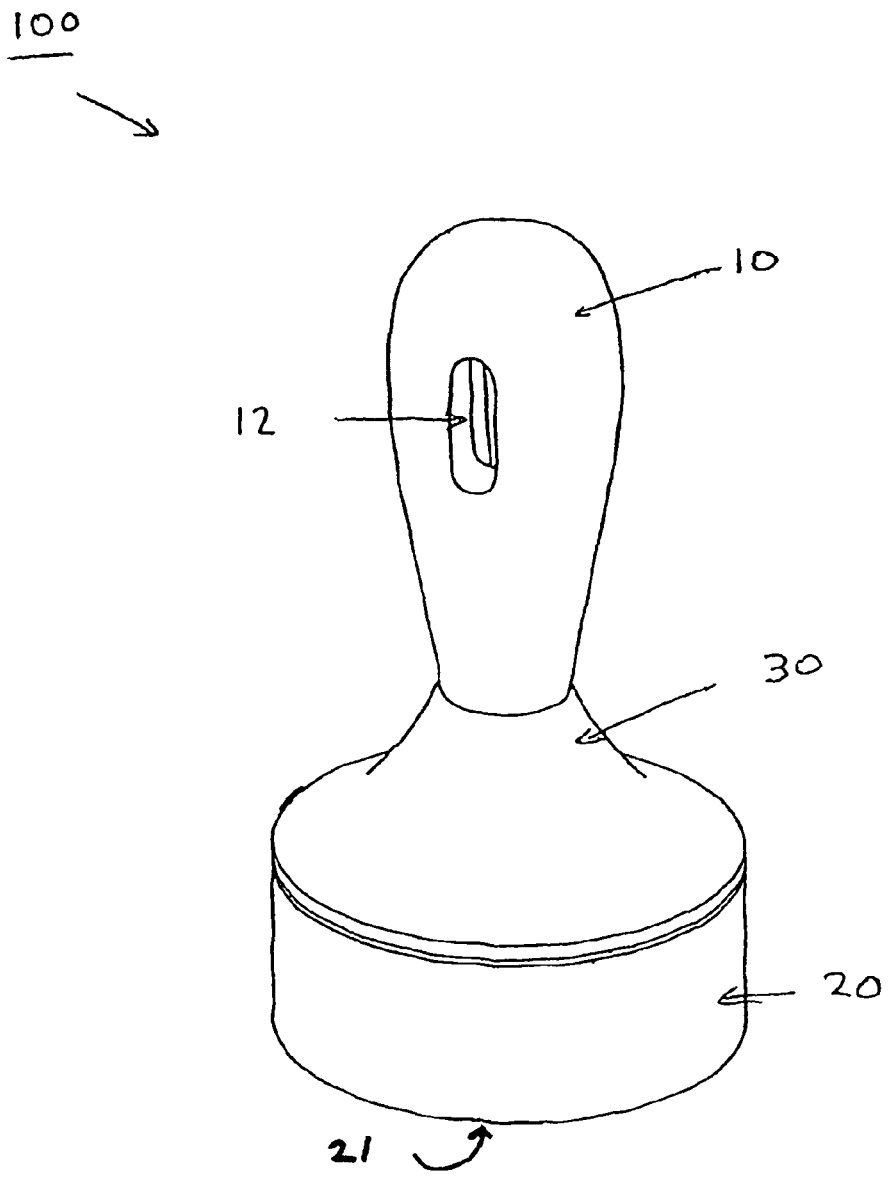
FIG. 2 schematically illustrates a baren according to an embodiment of the invention.

With reference to FIG. 2, according to an embodiment of the invention, a baren 100 comprises a base 20, and a handle 10 that can be used, in some applications, to apply manual pressure to the base 20. The base 20 has a surface 21 which is configured to transmit the pressure to a piece of work. For block printing applications, the pressure is applied with the aim of achieving good contact of paper (or other suitable material) with wet ink/dye on the block.

Figure 1:
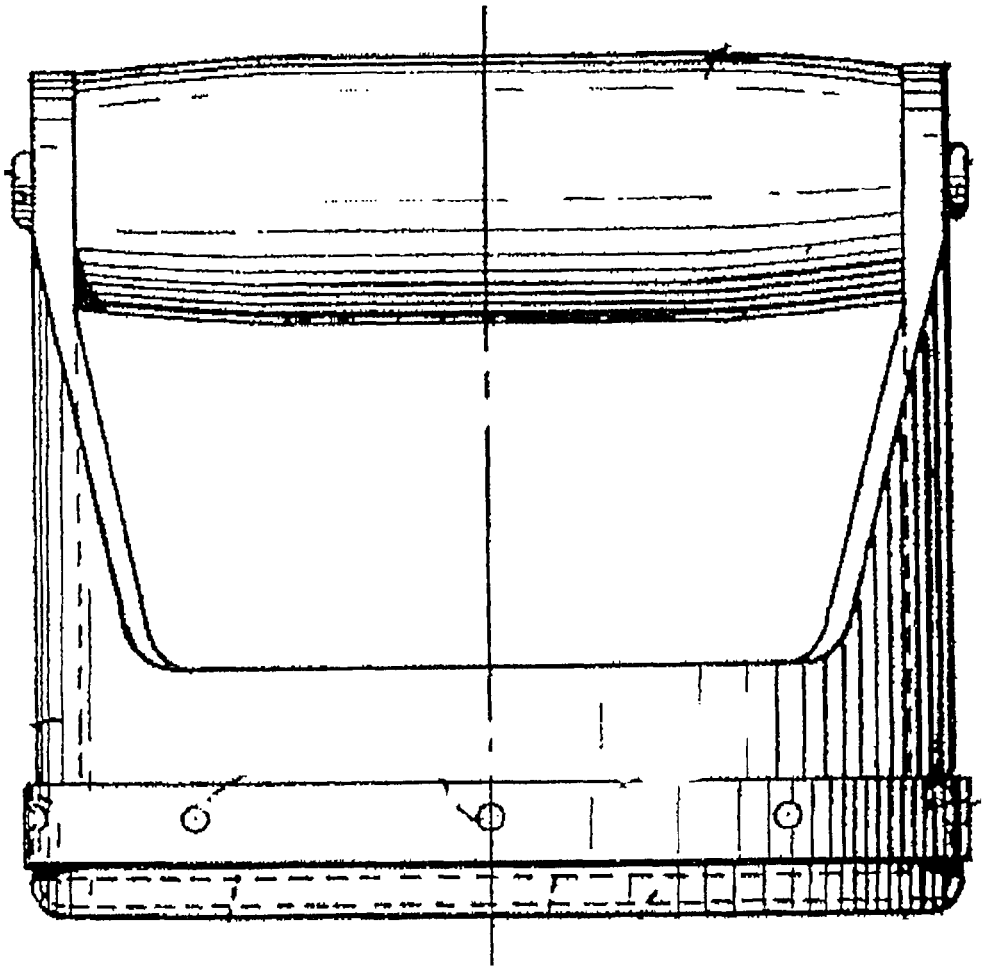
FIG. 1 schematically illustrates a prior art baren.

Generally the surface 21 of the base that is opposite to the handle 10 is substantially flat so that even pressure can be applied across substantially the extent of the surface 21. For the example baren 100 illustrated in FIG. 1 the surface 21 will be substantially circular but, according to embodiments of the invention, the surface 21 is not necessarily limited to any particular shape. The surface 21 could be termed "bottom surface" since in most applications substantially downward pressure is applied to this surface, however, in some applications pressure may be applied in a different direction.

The surface 21, in one example, is made from nylon, or a nylon type of material, such a material allowing the surface 21 to more easily glide over a piece of work (e.g. a piece of paper). Of course, other materials could be used to form the base 20 and/or the surface 21 with examples including, rubber, plastic, layered paper, wood (lacquered or un-lacquered), cord coils, and bamboo. In some cases the surface 21 is formed by an array of ball bearings.

Nylon is a slippery material which is suitable for a baren in most situations. However, for some delicate substrates, such as lightweight paper or tissue paper, a softer material, such as felt, might be more suitable. In such situations, the smoothing surface 21 may be formed from a layer of heavyweight felt. For example, a self-adhesive felt pad might be provided which could be placed over the surface 21 in the event that the user wishes to work with delicate paper. The felt pad can then be removed after an image has been transferred to the delicate paper, and either discarded or stored for further use at a later time. The nylon baren base can then be used to apply pressure to more robust substrates, without wearing out the delicate felt.

It will be appreciated that a variety of such detachable smoothing surfaces could be provided for connection to the baren, so that the surfaces can be interchanged depending on the substrate with which the baren is to be used. In such an embodiment, the baren base itself might be made from a lower cost material than nylon, such as plastic.

Returning to the Figure, the handle 10 may have an indentation or hole 12 so that the baren 100 can hung (e.g. from a hook) for storage or for display at the point of sale of the baren 100. In some embodiments, a cap 30 is provided between the handle 10 and the base 20. In this case, pressure can be transmitted to the base 20 by applying manual pressure to the cap 30 rather than by applying manual pressure to the handle 10 or directly onto the base 20. In this way the baren can be used in a technique in which the pressure of the body is applied substantially downward through the arm and the base of the palm into the piece of work. The cap 30 may be shaped to conform to the palm of the hand so as to aid the even distribution of pressure and/or make the baren more comfortable to use.

Figure 3:
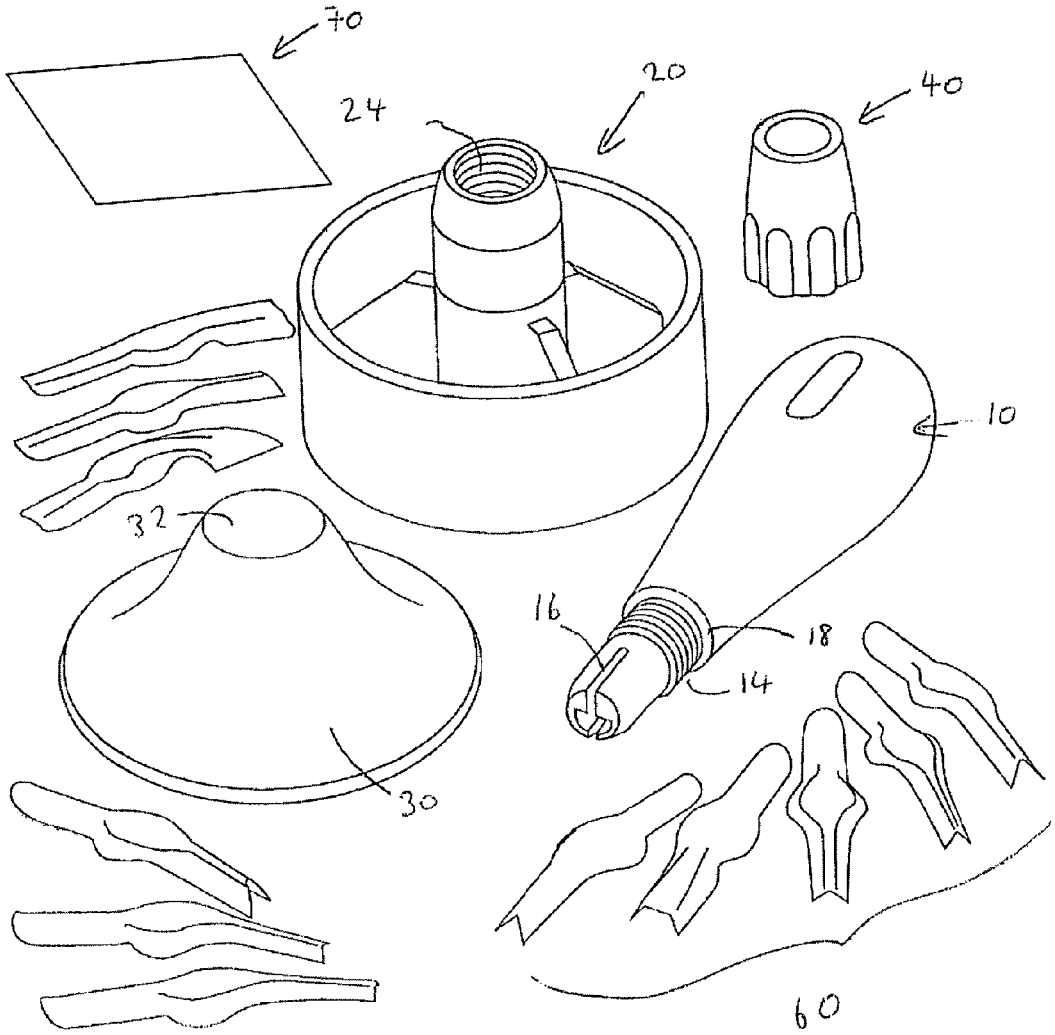
FIG. 3 schematically illustrates, according to an embodiment of the invention, apparatus comprising a disassembled baren together with blades and a ferrule according to an embodiment of the invention.
Figure 4:
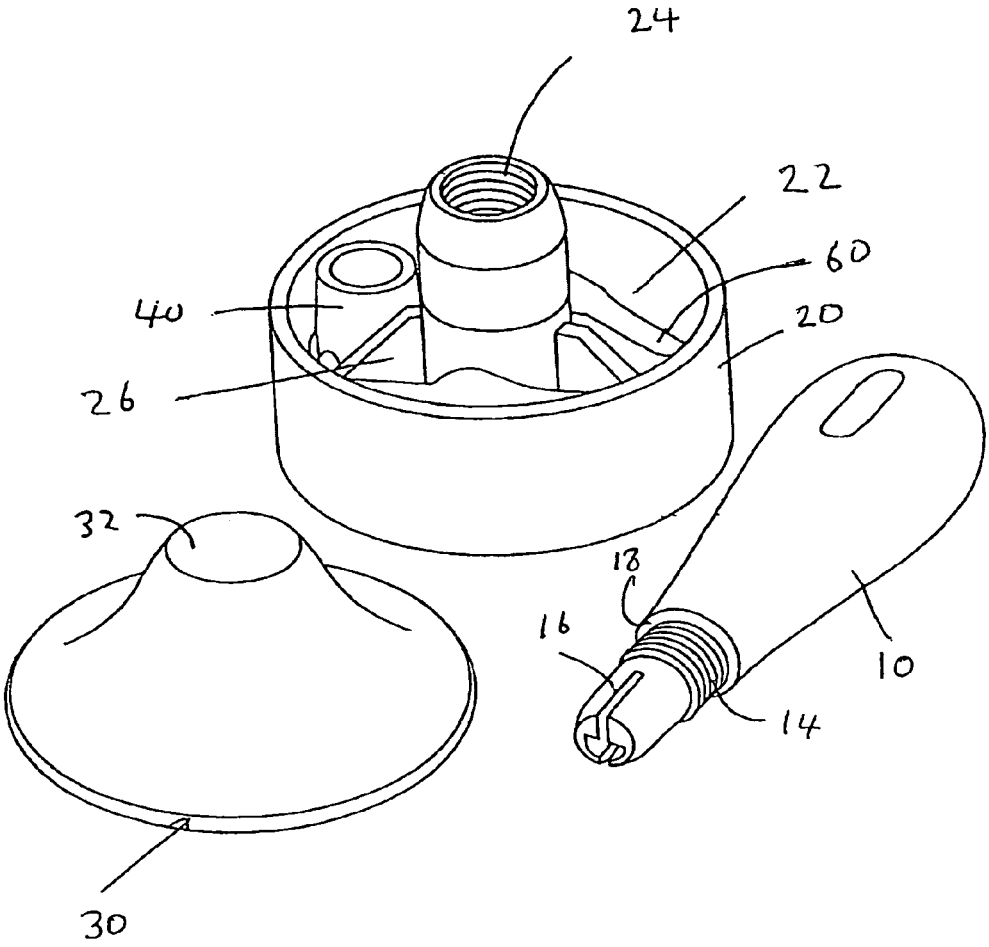
FIG. 4 schematically illustrates, according to an embodiment of the invention, the disassembled baren of FIG. 3 with the blades and the ferrule stored in a cavity of the base of the baren.

The handle 10 is removably connected to the base 20 so that the handle 10 can be disconnected from the base 20 and the handle 10 used as the handle for a cutting tool (as will be described in more detail below). In addition, in one particular form of use of the baren, the handle 10 is removed from the base before manual pressure is applied to the cap 30 (when using the baren for block printing or other craft that requires burnishing). FIGS. 3 and 4 show the handle 10 disconnected and separated from the base 20.

Referring to FIG. 3, in one embodiment, the handle 10 is provided with a screw thread 14 configured for threaded connection to a corresponding thread 24 in the base 20 or a thread 24 of an element connected to the base 20. In the embodiment illustrated in FIG. 3 the thread 24 associated with the base 20 is a threaded bore 24 whereas the thread 14 of the handle 10 is a threaded shaft 14.

The handle 10 has a blade-receiving end for receiving a blade 60 so that the handle 10 and blade 60 together form a craft knife. A number of example blades 60 are illustrated in FIG. 3. A blade 60 is attached to the handle 10 by inserting the blade 60 into, for example, a cruciform slot 16 at the blade-receiving end of the handle 10. A chuck or ferrule 40, in threaded connection with the blade-receiving end of the handle 10, can be screwed onto the handle to compress the cruciform slot 16 and thereby grip the blade 60, or unscrewed so that the blade 60 can be replaced. Conveniently, the threaded shaft 14 that is used to engage the handle 10 with the base 20 can also be used to engage the handle with the ferrule 40.

Referring to FIG. 4, the base 20 may have a cavity 22 for storing one or more blades 60 and/or the ferrule 40. The cap 30 is provided to substantially close off the cavity 22 so as to prevent the blades 60 falling out of the base 20. The cap 30 may be held in place over the base 60 by sandwiching the cap 30 between the handle 10 and the base 20 as shown in FIG. 2. In this case the cap 30 may be provided with a hole 32 so that the threaded shaft 14 may pass through the hole 32. The handle 10 may have an abutment 18 which abuts the cap 32 when the threaded shaft 14 is passed through the hole 32 and screwed into the threaded bore 24 of the base 20. In another embodiment the cap 30 may be held in connection with the base 20 by some other means, for example, the cap may screw onto the base.

In the example apparatus illustrated in FIGS. 3 and 4, the cavity 22 in the base is sectioned into a plurality of chambers by walls/dividers 26. The different chambers may be useful for storing different types of blade 60 and/or separating the blades 60 from the ferrule 40. In the example illustrated the chamber has 3 chambers but more or less chambers could be used (e.g. 2 or 5 chambers). To some extent the number of chambers is determined by the size of the base and the size of the blades/ferrule to be stored in the base.

FIG. 3 illustrates various types of blade 60 but embodiments of the invention are not necessarily restricted to any particular type of blade. For the blades illustrated each blade 60 may be formed from a single sheet of material which will generally be a sheet of tempered steel. The blades 60 are generally elongated and have a shank portion for insertion into the cruciform slot 16 of the handle 10. The shank portion widens into a stop portion that prevents the shank portion from being inserted too deeply into the cruciform slot 16.

For some of the blades illustrated, each blade 60 has a longitudinal channel that has a generally 'V' shaped, or 'U' shaped cross-section. The channel narrows towards the cutting end of the blade 60 and the cutting portion is formed in the channel at a cutting end of the blade 60. The cutting portion may have a ground surface on either the inside or outside of the channel, however a more effective cutting portion is produced if the ground surface is on the inside surface of the channel. The particular blades 60 illustrated are designed for block-cutting, for example block-cutting lino. Blades with different shaped cutting portions can be used according to the design required to be cut into the block, for example the cutting portion may have a cross-section that has a wide or narrow 'U' shape or a wide or narrow 'V' shape.

The base 20 of the baren 100, effectively forms a box for containing blades 60, for example the base 20 may be used to contain, for example, 1, 3, 5, 10 or more blades 60. The base 20 of the baren 100 therefore forms a box of sufficient size so that a wide range of different blades and spare blades may be accommodated.

The handle 20 and ferrule 40 may be sold separately (with or without blades 60) as part of a craft knife. Such a craft knife can therefore be easily converted to a baren 100 by providing a base 20 as described hereinabove. The base 100 may be sold separately with or without a cap 30 so as to convert a craft knife to a baren. Of course any combination of handle 10, base 20, cap 30, ferrule 40, blades 60 and instructions 70 may be sold as a kit or as individual items.

Figure 7:
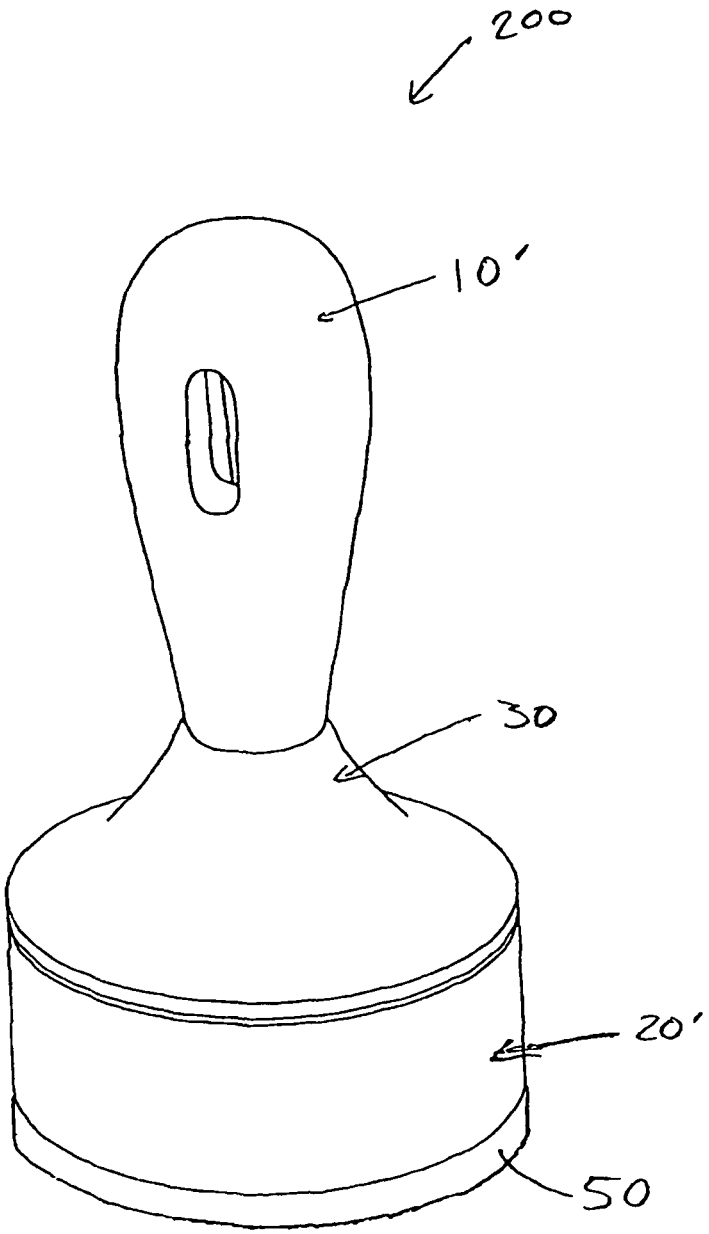
FIG. 7 schematically illustrates a stamp in accordance with the invention.

FIG. 7 shows another embodiment of a craft tool, namely a stamp 200. The stamp comprises a handle 10' and a base 20'. The handle 10' is provided with a threaded attachment so that it can be unscrewed from the base in the same way as described above. In addition, the handle 10' is shaped to receive craft blades in the same way as the handle 10 described above. In fact, the handle 10' is substantially identical to the handle 10 described above with reference to the baren of FIGS. 2, 3 and 4, and so will not be described in further detail.

In a similar manner to the baren base 20 discussed above, the stamp base 20' also comprises a cap 30' which provides a cover for an internal compartment inside the base (not shown, but similar to that in FIGS. 3 and 4). The compartment is adapted to hold craft blades. However, one way in which the stamp base 20' differs from the baren base 20 is that the stamp base 20' further comprises a stamping surface 50.

Figure 8:
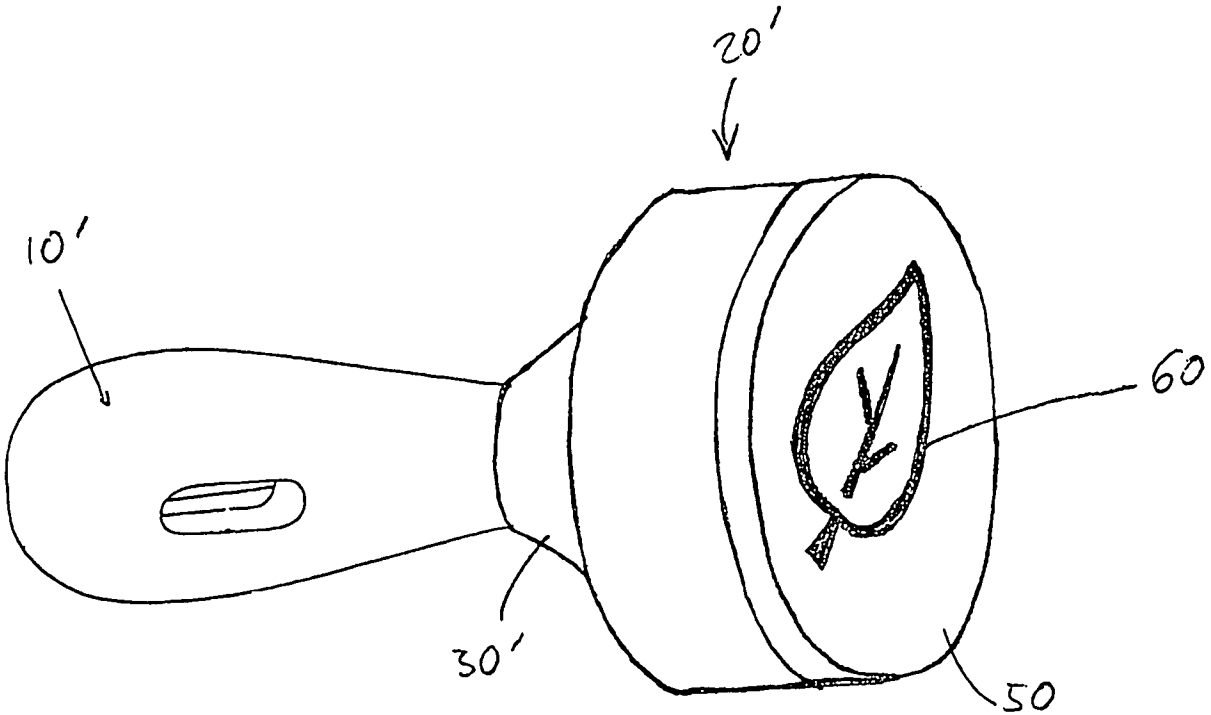
FIG. 8 is a perspective view of the stamp of FIG. 7 showing a stamping surface of the stamp.

The stamping surface 50 is substantially flat, and may be formed from or coated with a material suitable for transferring a marking medium (such as ink or paint) from the stamping surface to a substrate to be marked, such as paper, textile, wood, etc. A suitable material might be vinyl or rubber. The material from which the stamping surface 50 is made may be selected so that it can be carved using a craft blade. This allows a user to carve their own image 60 into the stamping surface 50, as shown in FIG. 8. In the embodiment shown, the stamping surface 50 is formed of PVC (polyvinylchloride) that is both lead and phalate free, which is a suitable material for carving.

In the embodiment shown in FIGS. 7 and 8 the stamping surface 50 is removably attached to the base 20', for example using a releasable fastening such as glue or a hook and loop fastener such as Velcro™. If desired, a user can remove the stamping surface 50 and replace it with a different stamping surface, allowing the user to change between different images without needing to purchase many different stamps. Instead only a number of stamping surfaces must be purchased. Those stamping surfaces could be purchased blank and then carved by the user (perhaps using blades stored inside the stamp, and the handle of the stamp), or might be purchased with pre-cut or pre-moulded images.

When the stamping surface is removed, the stamp 200 may function as a baren 100 as described above, as the bottom surface 21 of the base 20 creates a good surface for attaching self adhesive portions (e.g. self adhesive portions of PVC) to provide a good stamping tool. Alternatively, a baren smoothing surface 21, such as the felt pad discussed above, might be applied on top of or instead of the stamping surface.

It will be appreciated that the stamping surface 50 need not be removable, but could instead be permanently attached to or integral with the base 20'.

Figure 5:
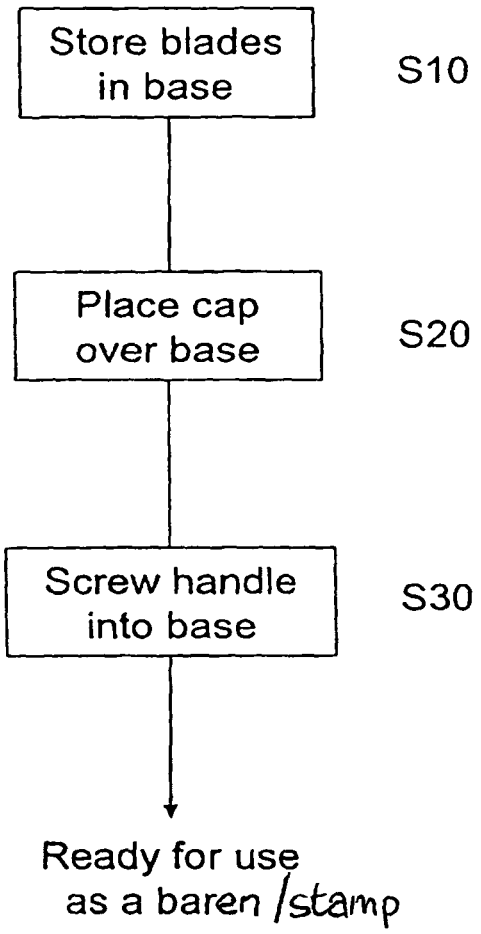
FIG. 5 is a flow diagram according to an embodiment of the invention.
Figure 6:
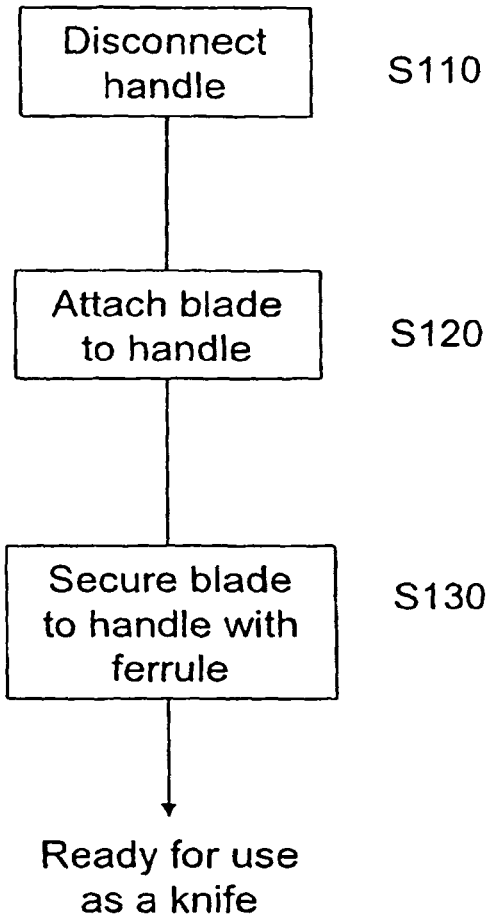
FIG. 6 is a flow diagram according to an embodiment of the invention.

Instructions 70 provided for use with the baren 100 or the stamp 200 may substantially follow the steps illustrated in the flow diagrams of FIG. 5 and FIG. 6. Not all the steps illustrated are necessarily essential and the steps illustrated may be modified or augmented with additional steps.

The flow diagram of FIG. 5 illustrates some steps that may be taken to use apparatus (for example the apparatus as illustrated in FIGS. 2, 3, 4 and 7 and 8) as a baren or stamp. The step of storing blades in the base (step S10) may be dispensed with if the user prefers to store the blades somewhere else. Similarly the step of attaching the handle to the base (step S30) may be performed without placing the cap over the base (step S20). In another case the cap may be placed on the base but the handle not connected to the base—in this case the combination of the cap and base may be used as a baren/stamp.

In the case of the stamp 200, the method may additionally comprise the step of carving an image into the stamping surface. That step may be performed whilst the stamping surface is attached to the base (especially in an embodiment where the stamping surface is integral with the base) or prior to a step of attaching the stamping surface to the base.

The flow diagram of FIG. 6 illustrates some steps that may be taken to use the apparatus as a knife. The step of disconnecting the handle from the base (step S110) may, of course, be irrelevant if the user is presented with the handle already separated from the base. Once a blade has been attached to the handle, at step S120, the blade is secured to the handle (for example by screwing a ferrule onto the blade receiving end of the handle).

The items of apparatus may be supplied in any of several combinations in the form of a kit together with instructions that generally follow the flow diagram (or a portion thereof) of FIG. 5 and/or the flow diagram (or a portion thereof) of FIG. 6, or a combination of the two. For example if the base and/or cap are sold or supplied separately then they could possibly be provided with instructions relating to the flow diagram (or a portion thereof) of FIG. 5 but without necessarily the instructions relating to the flow diagram (or a portion thereof) of FIG. 6.

In a further embodiment, (not shown but similar to the baren shown in FIG. 2) the base may function neither as a baren nor as a stamp, but may instead serve simply as a storage compartment for a plurality of craft tool tips, each of which are adapted for connection to the handle. In such an embodiment the base may be made of plastic. The tips might comprise craft blades, as discussed above, but might also comprise other craft tools, such as burnishers. A burnisher is a rounded tool commonly made from glass, metal, jade or agate, which is used to apply localised pressure to a surface, for example when embossing, or applying gold leaf to, a surface. A kit comprising a base and a selection of craft tool tips might be provided for a user to connect to an existing craft tool handle.

The invention claimed is:

1. A baren comprising a base having a substantially flat surface adapted for applying pressure to a work piece and a handle removably connected to the base, wherein the handle has an end that is adapted to receive a craft blade wherein the handle has a first end that has a screw thread for screwed connection to a corresponding thread associated with the base, wherein the first end of the handle is slotted for receiving a craft blade, and comprising a ferrule adapted for threaded connection with the first end of the handle for securing a craft blade into the handle.

2. The baren of claim 1 wherein the base has a cavity for storing one or more craft blades.

3. The baren of claim 2 comprising a removable cap for covering the cavity.

4. The baren of claim 2, comprising a removable cap for covering the cavity, and wherein the screwed connection of the handle with the base secures the cap over the cavity in the base.

5. The baren of claim 1 further comprising a stamping surface removably attached to the substantially flat surface so that the stamping surface can be removed from the base, and optionally reattached to the base.

6. The baren of claim 5, wherein the stamping surface is arranged so that an image can be cut into the stamping surface using a craft knife.

7. A kit comprising the baren of claim 2 and craft blades suitable for storing in the base of the baren.

8. The kit of claim 7 further comprising a stamping surface adapted for transferring a marking medium from the stamping surface to a substrate.

9. The kit of claim 7 further comprising instructions, wherein the instructions that substantially follow a method that comprises at least one of: unscrewing the handle from the base and connecting the craft blade to the handle; and removing a craft knife from the handle.

10. A method for using the baren of claim 1 comprising at least one of: unscrewing the handle from the base and connecting a craft knife to the handle; and removing a craft knife from the handle.

11. A baren comprising a base having a substantially flat surface adapted for applying pressure to a work piece and a handle removably connected to the base wherein the handle has an end that is adapted to receive a craft blade, wherein the base has a cavity for storing one or more craft blades, wherein the barren comprises a removable cap for covering the cavity, wherein the handle has a first end that has a screw thread for screwed connection to a corresponding thread associated with the base, wherein the screwed connection of the handle with the base secures the cap over the cavity in the base, wherein the first end of the handle is slotted for receiving a craft blade, and comprising a ferrule adapted for threaded connection with the first end of the handle for securing a craft blade into the handle.

12. The baren of claim 11 further comprising a stamping surface removably attached to the substantially flat surface so that the stamping surface can be removed from the base, and optionally reattached to the base.

13. The baren of claim 12, wherein the stamping surface is arranged so that an image can be cut into the stamping surface using a craft knife.

14. A kit comprising the baren of claim 11 and craft blades suitable for storing in the base of the baren or stamp.

15. The kit of claim 14 further comprising a stamping surface adapted for transferring a marking medium from the stamping surface to a substrate.

16. The kit of claim 11 further comprising instructions, wherein the instructions that substantially follow a method that comprises at least one of: unscrewing the handle from the base and connecting a craft knife to the handle; and removing a craft knife from the handle.

17. A method for using the baren of claim 11 comprising at least one of: unscrewing the handle from the base and connecting a craft knife to the handle; and removing a craft knife from the handle.

* * * * *